US008699928B2

(12) United States Patent
Takeshita et al.

(10) Patent No.: US 8,699,928 B2
(45) Date of Patent: Apr. 15, 2014

(54) FIXING UNIT AND ELECTROPHOTOGRAPHIC APPARATUS HAVING THE SAME

(75) Inventors: Masami Takeshita, Ibaraki (JP); Mamoru Takayama, Ibaraki (JP); Hiroshi Suzuki, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 239 days.

(21) Appl. No.: 13/137,419

(22) Filed: Aug. 15, 2011

(65) Prior Publication Data

US 2012/0051804 A1 Mar. 1, 2012

(30) Foreign Application Priority Data

Aug. 25, 2010 (JP) ..... 2010-188666

(51) Int. Cl.
*G03G 15/20* (2006.01)

(52) U.S. Cl.
USPC ..... 399/323

(58) Field of Classification Search
USPC ..... 399/122, 323
See application file for complete search history.

(56) References Cited

U.S. PATENT DOCUMENTS

| | | | | |
|---|---|---|---|---|
| 7,070,393 | B2 * | 7/2006 | Vertriest | 417/43 |
| 2004/0120735 | A1 * | 6/2004 | Baba et al. | 399/323 |
| 2006/0120886 | A1 * | 6/2006 | Friberg et al. | 417/313 |

FOREIGN PATENT DOCUMENTS

| | | | |
|---|---|---|---|
| JP | 6-67874 | | 9/1994 |
| JP | 9-317994 | | 12/1997 |
| JP | 3581960 | | 9/2002 |
| JP | 2003-286955 | | 10/2003 |
| JP | 2004-19443 | | 1/2004 |
| JP | 2007328168 | A | 12/2007 |
| JP | 2009186857 | A | 8/2009 |
| JP | 2009300704 | A | 12/2009 |

OTHER PUBLICATIONS

Translation of Masami (JP, 2009-186857, pub date: Aug. 20, 2009).*
Translation of Iguchi, JP 2002-276842,a publication date: Sep. 25, 2002.*
Abstract of JP 2009-300704 published Dec. 24, 2009.
Abstract of JP 2007-328168 published Dec. 20, 2007.
Abstract of JP 2009-186857 published Aug. 20, 2009.
Abstract of JP 2002-276842 published Sep. 25, 2002.
Jan. 21, 2014 Japanese Office Action issued in corresponding Application No. 2010-188666.

* cited by examiner

*Primary Examiner* — Walter L Lindsay, Jr.
*Assistant Examiner* — Frederick Wenderoth
(74) *Attorney, Agent, or Firm* — Harness, Dickey & Pierce, PLC

(57) ABSTRACT

A fixing unit includes: a heating roller; a pressing roller that is capable of being in pressure contact with the heating roller; a compressor that generates compressed air; an air tank that reserves therein the compressed air; a first pipe through which the compressed air generated by the compressor is fed into the air tank; an injection nozzle that is formed by the heating roller and the pressing roller and that causes the compressed air to blow a printing medium fed from the fixing nip; a second pipe through which the compressed air reserved in the air tank is fed into the injection nozzle; and a compressed air injection solenoid valve that is provided in middle of the second pipe. A droplet separator for separating a droplet from the compressed air is provided to the first pipe or to the second pipe.

6 Claims, 4 Drawing Sheets

FIXING UNIT AND ELECTROPHOTOGRAPHIC APPARATUS HAVING THE SAME

CROSS-REFERENCE TO RELATED APPLICATIONS

The present application claims priority to and incorporates by reference the entire contents of Japanese Patent Application No. 2010-188666 filed in Japan on Aug. 25, 2010.

BACKGROUND OF THE INVENTION

1. Field of the Invention

The present invention relates to a fixing unit of an electrophotographic apparatus.

2. Description of the Related Art

FIG. 3 is an outline configuration diagram of an electrophotographic apparatus having the compressed air supply device.

As illustrated in the drawing, the surface of a photosensitive element 1 that is rotated at a constant rotation speed in the direction indicated by the arrow is uniformly charged by a charging unit 7, and a laser beam is emitted from an exposure unit 8 onto the surface of the charged photosensitive element 1 to form an electrostatic latent image corresponding to the image information to be recorded. The electrostatic latent image is visualized with toner supplied by a developing unit 18 to form a toner image 5 on the surface of the photosensitive element 1.

When a sheet 6 fed at an appropriate timing passes through a gap between the photosensitive element 1 and a transfer unit 2 by being in contact with the photosensitive element 1, the toner image 5 on the photosensitive element 1 is transferred to the sheet 6. The sheet 6 to which the toner image 5 is transferred is electrostatically peeled off from the photosensitive element 1 by a peeling unit 3 and is conveyed to a fixing unit 10 by a conveying belt 4. In general, the sheet 6 is conveyed to the fixing unit 10 by being sucked by the conveying belt 4.

The toner image 5 on the sheet 6 fed to the fixing unit 10 is fixed to a surface of the sheet 6 by heat and pressure at a fixing nip 9 including a heating roller 11 and a pressing roller 12.

Due to a problem that the sheet 6 having passed through the fixing nip 9 tightly sticks, via the melted toner, to the heating roller 11 and is therefore not conveyed, Japanese Patent Application Laid-open No. 2009-300704 proposes a technique, for example, by which the sheet 6 is peeled off from the heating roller 11 with compressed air A that blows a leading end of the sheet 6.

In FIG. 3, an injection nozzle 13 spouts the compressed air A toward the sheet 6; the compressed air A is supplied to the injection nozzle 13 through a second pipe 14*b*; a compressed air injection solenoid valve 15 is provided in the middle of the second pipe 14*b*; an upper guide plate 20 and a lower guide plate 21 guide the sheet 6 peeled off from the heating roller 11 to the direction of a discharging unit (not illustrated).

FIG. 4 is an outline configuration diagram of a compressed air generator included in a fixing unit illustrated in Japanese Patent Application Laid-open No. 2009-300704.

The compressed air generated by a compressor 17 is allowed to pass through a first pipe 14*a* to be reserved in an air tank 16. The air tank 16 is connected with the injection nozzle 13 by the second pipe 14*b* through the compressed air injection solenoid valve 15. The solenoid valve 15 is a normally closed solenoid valve, and the pressure in the air tank 16 is maintained with the solenoid valve 15 being closed.

When a leading end of the sheet 6 reaches a predetermined position, the compressed air injection solenoid valve 15 is opened for a predetermined period of time, and the released compressed air A is spouted from the injection nozzle 13 to peel off the sheet 6 from the heating roller 11, thus preventing the sheet from sticking to the heating roller 11.

However, if the pressure of the compressed air is too weak, the sheet 6 cannot be reliably peeled off. Conversely, if the pressure of the compressed air is too strong, the sheet 6 is buckled or the posture of the sheet 6 is off-balanced, resulting in a trouble in conveying the sheet. Therefore, it is necessary to properly adjust and maintain the pressure, and accordingly, a pressure adjusting valve 19 is provided to the air tank 16. The pressure adjusting valve 19 allows a surplus of the compressed air generated by the compressor 17 to be released to the atmosphere, so that the whole pressure of a compressed air circuit can be appropriately maintained.

It should be noted that a method and an apparatus for automatically discharging a droplet are described in, for example, Japanese Patent No. 3581960.

When the air is compressed, the dew-point temperature of the air increases. When the temperature of the compressed air falls below the dew-point temperature, water vapor contained in the air is condensed to turn into a droplet. In general, it has been known that when the air is continuously compressed and the droplets are not drained from the compressed air circuit, the droplets are reserved in the compressed air circuit to cause a trouble.

If the droplets are reserved in the compressed air circuit in the conventional fixing unit illustrated in FIG. 4, the droplets are spouted from the injection nozzle 13 together with the compressed air, and the sheet 6 gets wet, thus causing the print quality to be markedly deteriorated. Furthermore, the droplet washes away grease used in the compressed air injection solenoid valve 15 to shorten the durable life of the solenoid valve 15.

SUMMARY OF THE INVENTION

It is an object of the present invention to at least partially solve the problems in the conventional technology.

According to an aspect of the present invention, there is provided a fixing unit that includes: a heating roller; a pressing roller that is capable of being in pressure contact with the heating roller; a compressor that generates compressed air; an air tank that reserves therein the compressed air; a first pipe through which the compressed air generated by the compressor is fed into the air tank; an injection nozzle that is provided at a downstream in a printing-medium conveying direction relative to a fixing nip formed by the heating roller and the pressing roller and that causes the compressed air to blow a printing medium fed from the fixing nip; a second pipe through which the compressed air reserved in the air tank is fed into the injection nozzle; a compressed air injection solenoid valve that is provided in middle of the second pipe. A droplet separator for separating a droplet from the compressed air is provided to either one of the first pipe between the compressor and the air tank and the second pipe between the air tank and the compressed air injection solenoid valve. A first droplet discharging pipe extends from the droplet separator and a second droplet discharging pipe extends from a bottom portion of the air tank, and the first and second discharging pipes join together with one droplet discharging solenoid valve arranged at a downstream of a joining portion in a droplet discharging direction.

According to another aspect of the present invention, there is provided an electrophotographic apparatus that includes: a photosensitive element; a charging unit that charges a surface of the photosensitive element; an exposure unit that forms an electrostatic latent image on the surface of the charged photosensitive element; a developing unit that make visible the electrostatic latent image with a supply of toner to form a toner image; a transfer unit that transfers the toner image on the photosensitive element to a conveyed printing medium; and a fixing unit that fixes the toner image transferred to the printing medium, wherein the fixing unit includes: a heating roller; a pressing roller that is capable of being pressed to be in contact with the heating roller; a compressor that generates compressed air; an air tank that reserves therein the compressed air; a first pipe through which the compressed air generated by the compressor is fed into the air tank; an injection nozzle that is provided at a downstream in a printing-medium conveying direction relative to a fixing nip including the heating roller and the pressing roller and that causes the compressed air to blow a printing medium fed from the fixing nip; a second pipe through which the compressed air reserved in the air tank is fed into the injection nozzle; and a compressed air injection solenoid valve that is provided in middle of the second pipe. A droplet separator for separating a droplet from the compressed air is provided to the first pipe between the compressor and the air tank or to the second pipe between the air tank and the compressed air injection solenoid valve, and a first droplet discharging pipe extending from the droplet separator and a second droplet discharging pipe extending from a bottom portion of the air tank are allowed to join together, of which joined part is provided with one droplet discharging solenoid valve.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
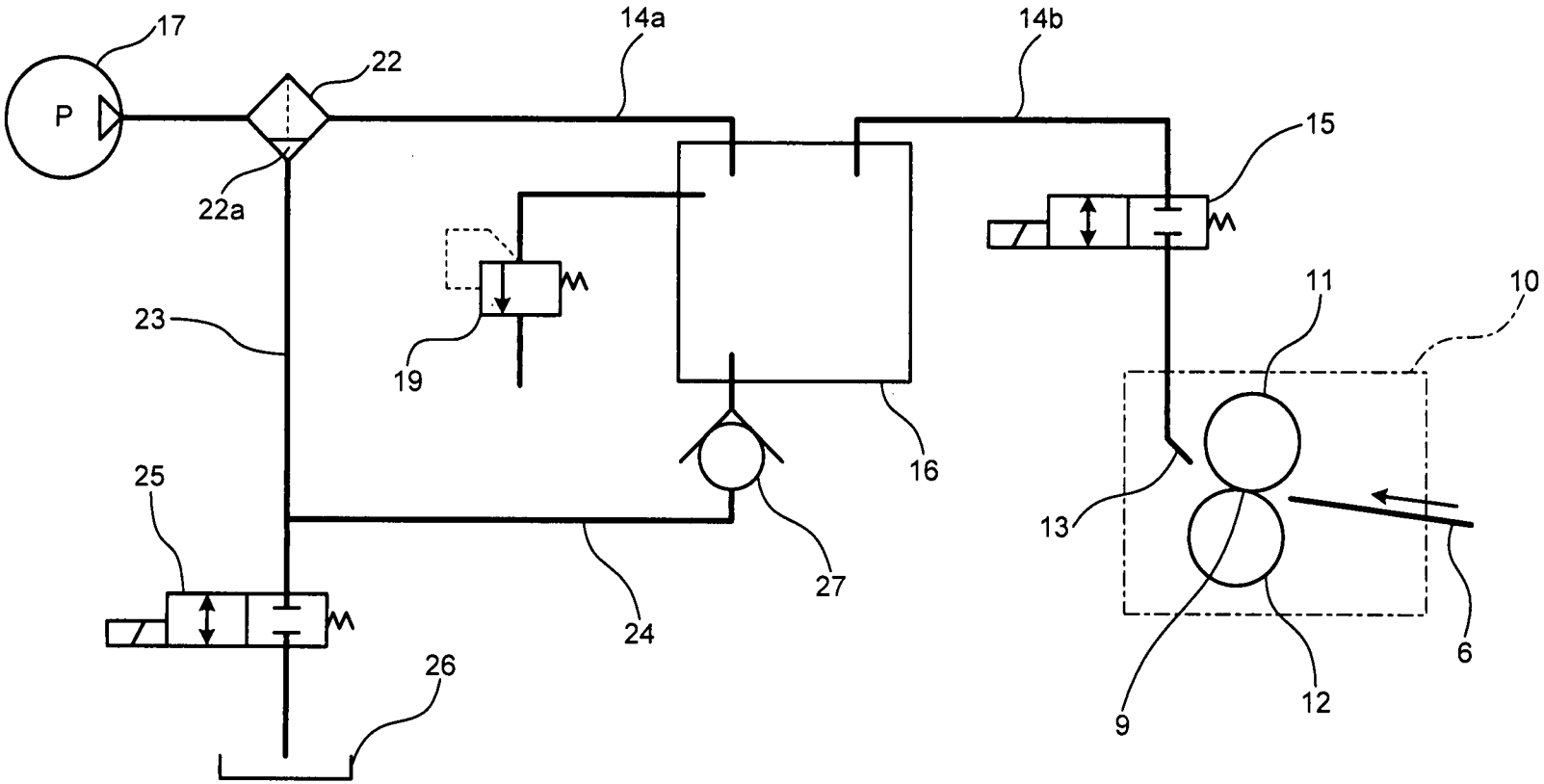
FIG. 1 is an outline configuration diagram of a compressed air generator of a fixing unit according to a first embodiment of the present invention.

Next, embodiments of the present invention will be described with reference to the drawings. FIG. 1 is an outline configuration diagram of a compressed air generator of a fixing unit according to a first embodiment of the present invention.

Figure 3:
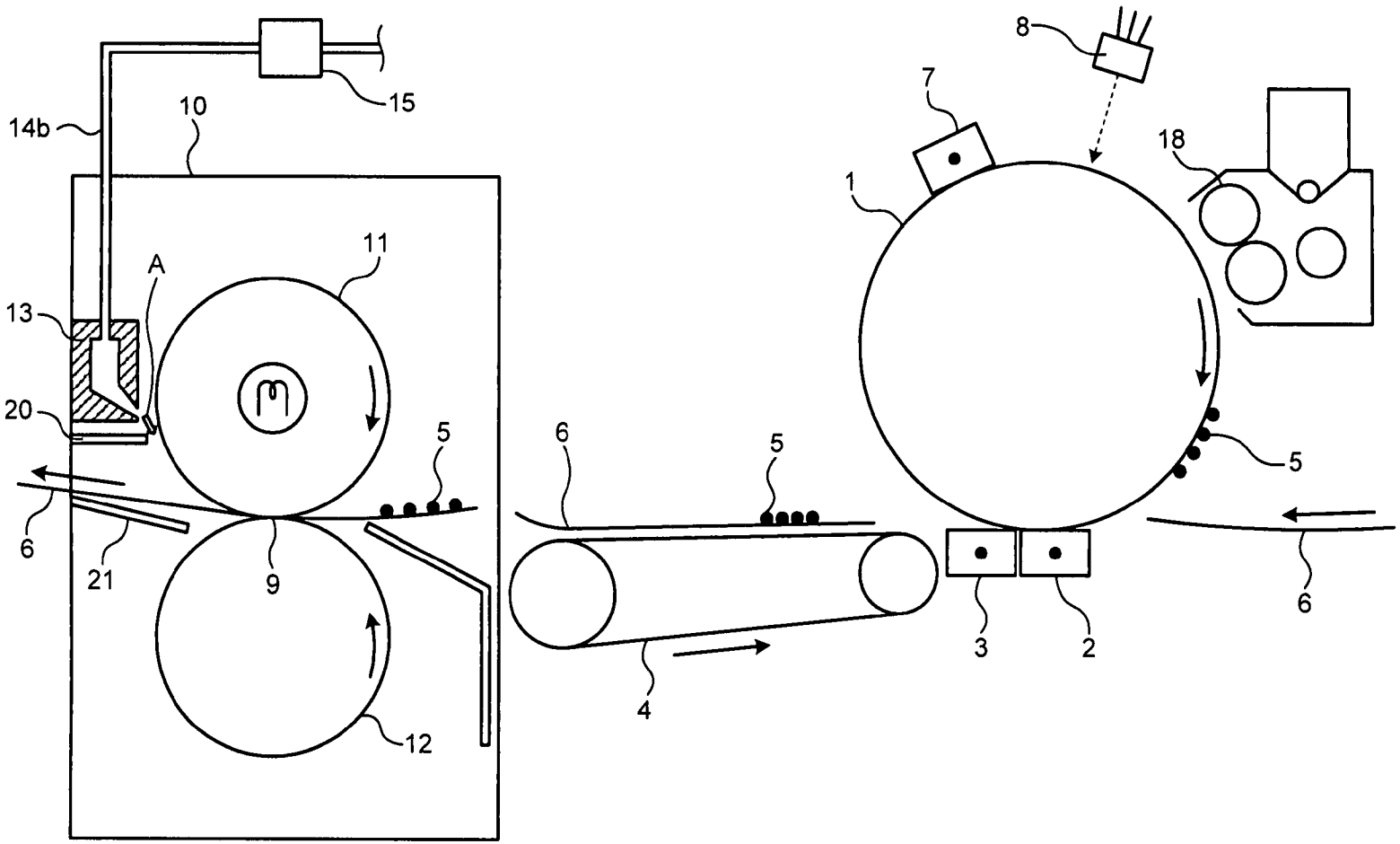
FIG. 3 is an outline configuration diagram of an entire electrophotographic apparatus.
Figure 4:
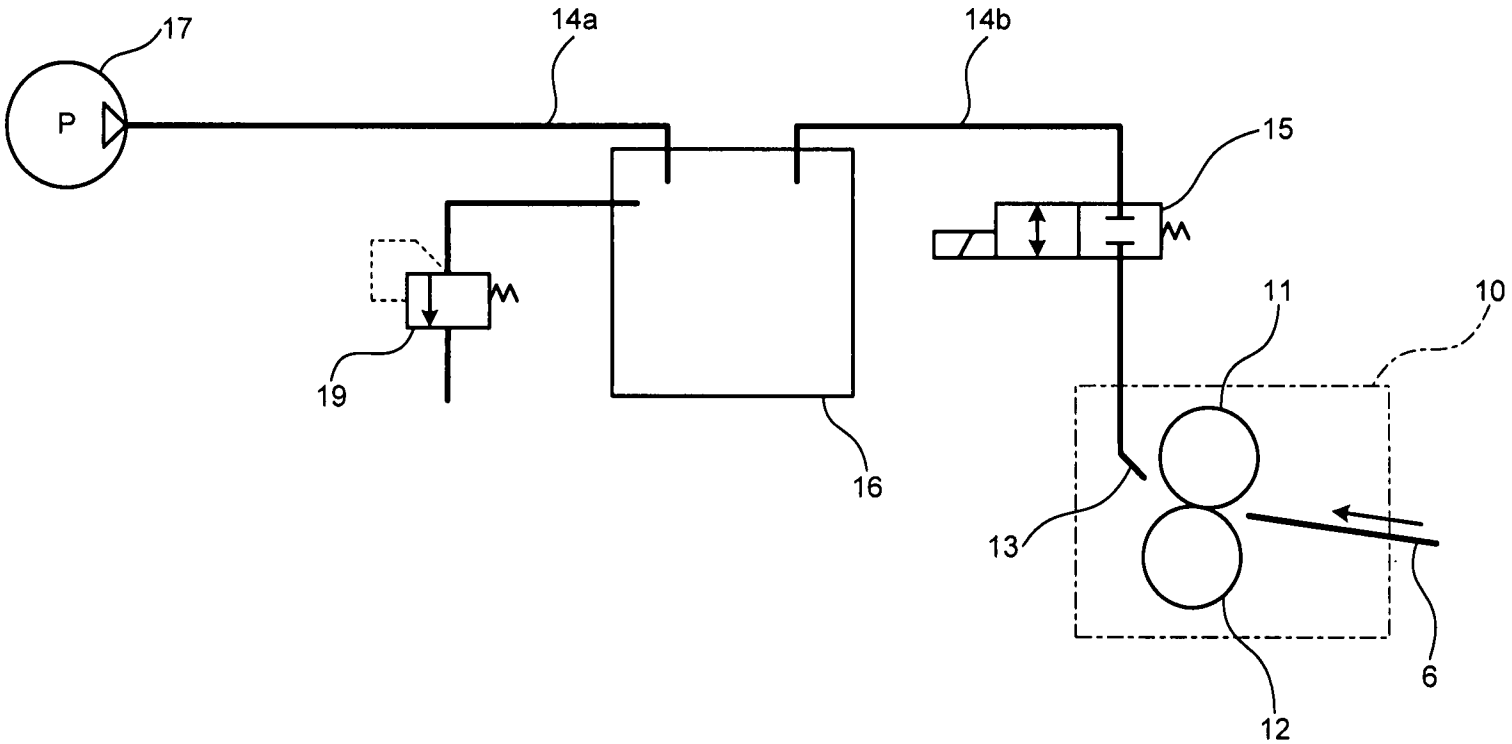
FIG. 4 is an outline configuration diagram of a compressed air generator of a conventional fixing unit.

An electrophotographic apparatus according to the first embodiment also includes, similarly to the one illustrated in FIG. 3, a photosensitive element 1 that is rotated at a constant speed in a predetermined direction, a charging unit 7 that uniformly charges the surface of the photosensitive element 1, an exposure unit 8 that emits a laser beam to the surface of the charged photosensitive element 1 so as to form an electrostatic latent image corresponding to image information to be recorded, a developing unit 18 that makes the electrostatic latent image visible with a supply of toner to form a toner image 5, a transfer unit 2 that transfers the toner image 5 on the photosensitive element 1 to sheet 6 having been conveyed to a fixing unit 10, and the fixing unit 10 that fixes, on the sheet 6, the toner image 5 transferred to the sheet 6.

In the fixing unit 10, the toner image 5 is fixed to a surface of the sheet 6 by heat and pressure at a fixing nip 9 including a heating roller 11 and a pressing roller 12 that can be pressed to be in contact with the heating roller 11.

In order to avoid a problem that the sheet 6 having passed through the fixing nip 9 tightly sticks to the heating roller 11 due to the melted toner and is not conveyed, an injection nozzle 13 is provided at the downstream in the sheet conveying direction, so that the sheet 6 is peeled off from the heating roller 11 with compressed air A blowing to a leading end of the sheet 6.

As illustrated in FIG. 1, in the compressed air generator of the fixing unit according to the first embodiment, the compressed air generated by a compressor 17 passes through a first pipe 14*a* to be reserved in an air tank 16. The injection nozzle 13 and the air tank 16 are connected to each other through a second pipe 14*b*, in the middle of which a compressed air injection solenoid valve 15 is provided. The solenoid valve 15 is a normally closed solenoid valve, and the pressure in the air tank 16 is maintained with the solenoid valve 15 being closed.

When a paper sensor (not illustrated) detects that a leading end of the sheet 6 reaches a predetermined position, the compressed air injection solenoid valve 15 is opened for a predetermined period of time on the basis of the detected signal. Then, the released compressed air A is spouted from the injection nozzle 13 to peel off the sheet 6 from the heating roller 11, and prevents the sheet 6 from sticking to the heating roller 11.

The presence or absence of injection of the compressed air A from the injection nozzle 13, injection time, and the number of times of injections are predetermined by the degree of stiffness, which depends on the thickness, of the sheet 6 to be used. For example, a control unit (not illustrated) preliminarily installs therein computer programs that causes the injection nozzle 13 to spout the compressed air A twice in a short period of time to the sheet 6 with a small thickness and a low degree of stiffness, once with a slightly longer period of time than the above case to the sheet 6 with a normal thickness, and to stop to spout the compressed air A to the sheet 6 with a large thickness and a high degree of stiffness.

Accordingly, various types of sheet ranging from thin sheet to thick sheet can be prevented from being jammed, and the reliability in printing can be improved.

A pressure adjusting valve 19 is provided to the air tank 16 to discharge a surplus of the compressed air generated by the compressor 17 to the atmosphere and the entire pressure of the compressed air circuit is properly maintained.

An air filter 22 is provided in the middle of the first pipe 14*a* through which the compressor 17 and the air tank 16 are connected to each other. The air filter 22 has a function of collecting foreign substances such as dust and a function of collecting droplets.

In the first embodiment, A1019-2C-FL439853 manufactured by CKD Corporation is used as the air filter 22. The air filter 22 is formed by inserting foam made of polypropylene into a zinc alloy die-casting, and the filtration degree thereof is about 5 μm.

A droplet reservoir 22*a* is incorporated in a lower part of the air filter 22. A first droplet discharging pipe 23 extends downward from the droplet reservoir 22*a*. In addition, a droplet discharging solenoid valve 25 is connected to a leading end of the first droplet discharging pipe 23.

Furthermore, a second droplet discharging pipe 24 is connected to a lower part of the air tank 16. A leading end of the second droplet discharging pipe 24 is connected to and is joined together with the first droplet discharging pipe 23 provided between the air filter 22 and the droplet discharging solenoid valve 25. An evaporating dish 26 used for natural evaporation of the droplets are arranged under an outlet of the droplet discharging solenoid valve 25.

A backflow prevention valve 27 is provided in the middle of the second droplet discharging pipe 24. The backflow prevention valve 27 blocks a flow of air blowing toward the air tank 16 and permits only an air flow blowing toward the droplet discharging solenoid valve 25.

It may look sufficient to connect the first droplet discharging pipe 23 under the air filter 22 and the second droplet discharging pipe 24 under the air tank 16 without using the backflow prevention valve 27. However, if the backflow prevention valve 27 is not provided, the air flows out to the air tank 16 from the lower part of the air filter 22 without passing through a filter inside the air filter 22. This is because air resistance in a flowing route from the lower part of the air filter 22 to the air tank 16 not through the filter inside the air filter 22 is smaller than that in a flowing route to the air tank 16 through the filter inside the air filter 22.

As a result, the air containing dust, foreign substances, and the like reaches the compressed air injection solenoid valve 15 to shorten the durable life of the solenoid valve 15. Thus, it is necessary to provide the backflow prevention valve 27 that permits only a flow to discharge droplets.

The droplet discharging solenoid valve 25 can be provided at each of the leading ends of the first droplet discharging pipe 23 and the second droplet discharging pipe 24 instead of connecting the second droplet discharging pipe 24 to the first droplet discharging pipe 23. However, providing the two units of the droplet discharging solenoid valve 25 results in an increase in cost. Furthermore, providing the two units of the droplet discharging solenoid valve 25 with a relatively short durable life in the fixing unit increases a chance of failure, resulting in deterioration in operational reliability as an electrophotographic apparatus (fixing unit).

In contrast, the backflow prevention valve 27 used in the present invention is a mechanical component, and costs less than to provide the two units of the droplet discharging solenoid valve 25 as described above. In addition, the backflow prevention valve 27 has a longer durable life than the droplet discharging solenoid valve 25 does, and the chance of failure is reduced as compared with the case in which the two units of the droplet discharging solenoid valve 25 are provided, leading to improvement of operational reliability as an electrophotographic apparatus (fixing unit).

In general, an electrophotographic apparatus requires, after the electric power is turned on, a few minutes of preparation time to prepare for printing in heating the fixing rollers (the heating roller and the pressing roller) and adjusting electronic conditions for respective constituent devices. Furthermore, it is necessary to interrupt the printing due to sheet jam, a refill of consumables and sheet, sheet removing work, and the like. In general, interruption time of printing due to the troubles listed above occurs at least a few times a day.

The operation of opening the droplet discharging solenoid valve 25 in a state where the compressed air is reserved by operating the compressor 17 during the preparation time and the interruption time is pre-installed in a control program of the electrophotographic apparatus, and a droplet discharging operation is executed for a few seconds and is completed. Furthermore, in the case where the electrophotographic apparatus continuously runs without a halt, the printing may be forcibly interrupted to execute the droplet discharging operation for a few seconds. Alternatively, this operation may be performed immediately after the printing is stopped.

If the droplet discharging operations are frequently performed, the amount of droplet discharged at a time is reduced in inversely proportional to the frequency. The operation period of time of the compressor 17 is at least about 3 seconds. Given that the opening period of time of the droplet discharging solenoid valve 25 is about 0.3 to 3 seconds and the inner diameters of the droplet discharging pipes 23 and 24 are, for example, 3 to 5 millimeters, several cubic centimeters (cc) to more than ten cc of water can be drained.

If a pressure of the pressure adjusting valve 19 is set at 0.05 MPa to 0.3 MPa and the discharging performance of the compressor 17 is 5 L/min (at 0.3 MPa) to 20 L/min (at 0.3 MPa), the amount of droplets collected in continuous operations for 24 hours a day is a dozen cc at the most, and the droplets can be discharged under the above-described conditions.

As long as the amount of discharged water is a dozen cc at the most, the droplet can be discharged to the evaporating dish 26 and left to natural evaporation. Specifically, neither providing the droplet discharging port outside the electrophotographic apparatus nor connecting the droplet discharging port to a sewer pipe for discharging droplets is necessary. Thus, a space for placing the electrophotographic apparatus can be made small. In general, a diaphragm compressor is preferable as the compressor 17 that meets the above-described conditions.

Figure 2:
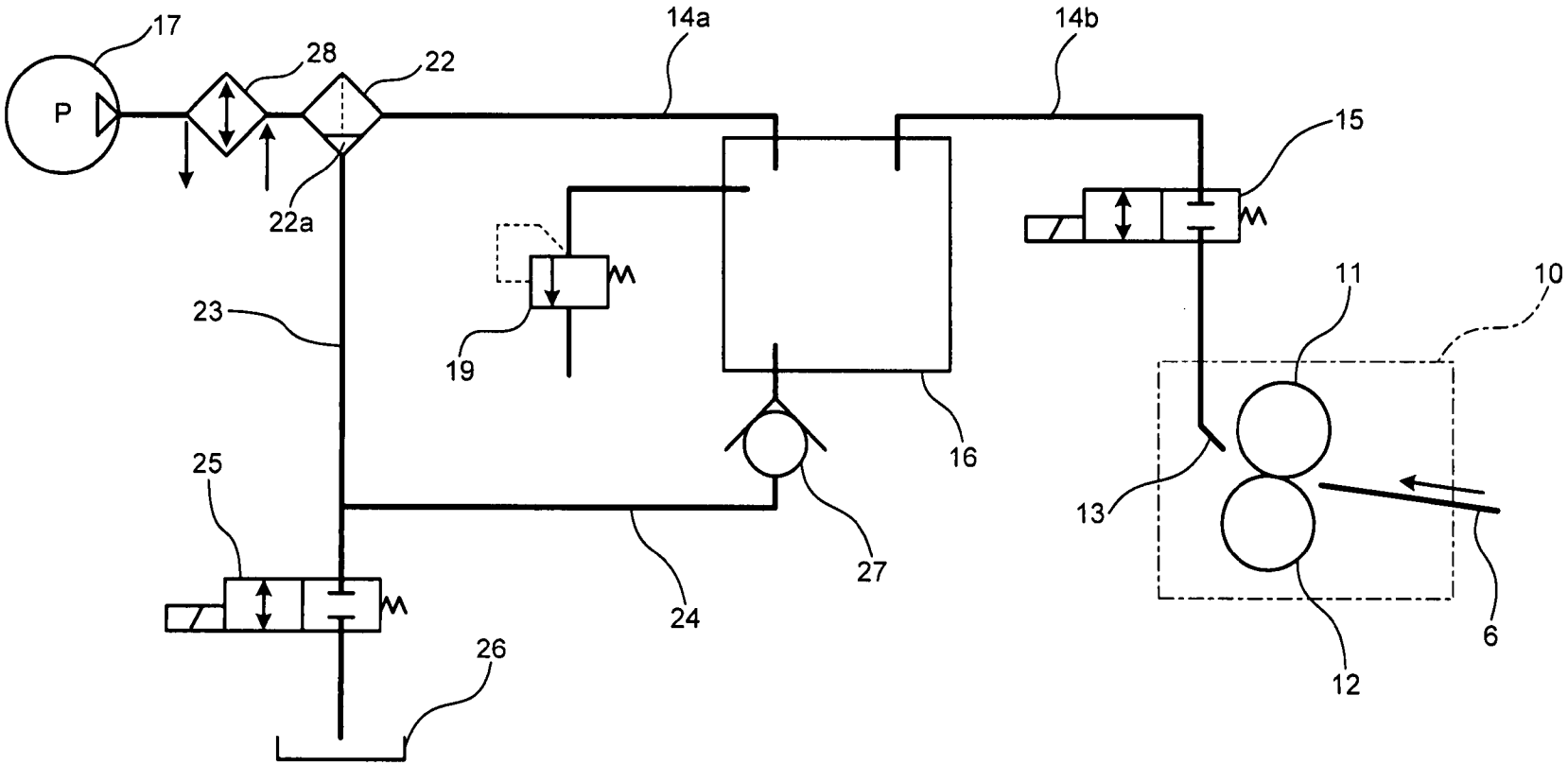
FIG. 2 is an outline configuration diagram of a compressed air generator of a fixing unit according to a second embodiment of the present invention.

FIG. 2 is an outline configuration diagram of a compressed air generator of a fixing unit according to a second embodiment of the present invention. The second embodiment is different from the first embodiment in that a cooler 28 as a second droplet separator is arranged between the compressor 17 and the air filter 22.

As described above, if the cooler 28 is arranged before the air filter 22 (first droplet separator) and the compressed air to be fed to the air filter 22 is cooled by the cooler 28 to condense and separate, in advance, part of the vapor by forming droplets, the electrophotographic apparatus can be used under, for example, a high humidity condition. In addition, the amount of droplets generated can be reduced under a normal use conditions. As a refrigerant in the cooler 28, normal water or organic liquid is used.

In the first embodiment, the air filter 22 is provided on the first pipe 14*a* between the compressor 17 and the air tank 16. However, the air filter 22 may be provided on the second pipe 14*b* between the air tank 16 and the compressed air injection solenoid valve 15.

According to the present invention, sheet is used as a printing medium. However, the present invention can be applied to a case in which different printing media such as overhead projector (OHP) sheets are used.

Next, advantageous effects obtained by the claims of the present invention will be described as follows.

According to the present invention, only one droplet discharging solenoid valve is necessary, and the numbers of wirings, control-related units, and electric power units for actuating the solenoid valve can be reduced along with the reduction in the number of the droplet discharging solenoid valve. In addition, the chance of failure of the solenoid valve becomes low as compared to a case in which a plurality of droplet discharging solenoid valves are provided. Thus, it is possible to provide a fixing unit that is inexpensive, requires less space, and is high in operational reliability.

According to the present invention, downsizing and reducing cost of the fixing unit can be realized by using an air filter as a droplet separator.

According to the present invention, a backflow prevention unit that blocks a flow toward an air tank is provided to a second droplet discharging pipe, so that it is possible to solve the problem that the air containing dust, foreign substances, and the like reaches a compressed air injection solenoid valve to shorten the durable life of the solenoid valve.

According to the present invention, a unit for reserving therein droplets is provided on the outlet side of the droplet discharging solenoid valve. In addition, according to the present invention, the unit for reserving therein the droplets is an evaporating dish. Thus, it is not necessary to provide a droplet discharging port outside the main body of the electrophotographic apparatus, and the electrophotographic apparatus can be more easily placed.

According to the present invention, a compressed air cooling unit is provided between a compressor and the air filter, so that the compressed air to be fed to the air filter is cooled by the compressed air cooling unit and part of condensed vapor droplets can be removed in advance.

In the case where the fixing unit is used under stronger sticking strength to a heating roll (for example, in the case where toner having high melt viscosity is used, or in the case where the amount of toner sticking to sheet is increased to improve the print quality), it is necessary to enhance the performance of peeling off the sheet by increasing the number of injection nozzles, the air pressure, and the opening period of time of the solenoid valve. As a result, it is necessary to enhance the discharging performance of the compressor. Furthermore, if the printing speed of the electrophotographic apparatus becomes fast even under the same sticking strength to the heating roll, the number of times to open the solenoid valve is increased. In this case, too, it is necessary to enhance the discharging performance of the compressor. A piston-type compressor with a discharge performance of about 20 L/min (at 0.4 MPa) to 40 L/min (at 0.4 MPa) is used instead of a diaphragm compressor.

In the above-described case, much compressed air is fed to the inside of the pipe. Thus, the amount of droplets is increased to exceed the droplet separating capability of the air filter. Thus, it is advantageous to provide the compressed air cooling unit. Accordingly, it is possible to provide a fixing unit that can realize high-quality and high-speed printing.

According to the present invention, it is possible to provide an electrophotographic apparatus that is inexpensive, requires less space, and is high in operational reliability.

According to the present invention, the droplet can be discharged without having impacts on the printing operations of the electrophotographic apparatus.

The present invention is configured as described above, and can provide a highly reliable fixing unit and an electrophotographic apparatus having the same by which droplet generated in a compressed air circuit is discharged to prevent deterioration in the print quality caused by the droplets and to prevent a reduction in the durable life of a compressed air injection solenoid valve.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing unit comprising:

a heating roller;

a pressing roller that is capable of being in pressure contact with the heating roller;

a compressor that generates compressed air;

an air tank that reserves therein the compressed air;

a first pipe through which the compressed air generated by the compressor is fed into the air tank;

an injection nozzle that is provided at a downstream in a printing-medium conveying direction relative to a fixing nip formed by the heating roller and the pressing roller and that causes the compressed air to blow a printing medium fed from the fixing nip;

a second pipe through which the compressed air reserved in the air tank is fed into the injection nozzle;

a compressed air injection solenoid valve that is provided in middle of the second pipe;

a droplet separator that separates a droplet from the compressed air, the droplet separator being provided to either one of the first pipe between the compressor and the air tank and the second pipe between the air tank and the compressed air injection solenoid valve;

a first droplet discharging pipe that extends from the droplet separator and a second droplet discharging pipe that extends from a bottom portion of the air tank, the first and second discharging pipes joining together with one droplet discharging solenoid valve arranged at a downstream of a joining portion in a droplet discharging directions; and a unit for reserving therein discharged droplets provided on an outlet side of the droplet discharging solenoid valve.

2. The fixing unit according to claim 1, wherein the droplet separator is an air filter including a droplet reservoir incorporated therein.

3. The fixing unit according to claim 1, further comprising a backflow prevention unit that blocks a flow of gas blowing toward the air tank and that is provided to the second droplet discharging pipe.

4. The fixing unit according to claim 1, wherein the unit for reserving therein the droplets is an evaporating dish.

5. The fixing unit according to claim 2, wherein the air filter is provided to the first droplet discharging pipe, and the fixing unit further comprises a compressed air cooling unit that cools and condenses the compressed air to separate part of the resultant droplets in advance and that is provided between the compressor and the air filter.

6. An electrophotographic apparatus comprising:

a photosensitive element;

a charging unit that charges a surface of the photosensitive element;

an exposure unit that forms an electrostatic latent image on the surface of the charged photosensitive element;

a developing unit that make visible the electrostatic latent image with a supply of toner to form a toner image;

a transfer unit that transfers the toner image on the photosensitive element to a conveyed printing medium; and a fixing unit that fixes the toner image transferred to the printing medium, wherein the fixing unit includes:

a heating roller;

a pressing roller that is capable of being in pressure contact with the heating roller;

a compressor that generates compressed air;

an air tank that reserves therein the compressed air;

a first pipe through which the compressed air generated by the compressor is fed into the air tank;

an injection nozzle that is provided at a downstream in a printing-medium conveying direction relative to a fixing nip formed by the heating roller and the pressing roller and that causes the compressed air to blow a printing medium fed from the fixing nip;

a second pipe through which the compressed air reserved in the air tank is fed into the injection nozzle;

a compressed air injection solenoid valve that is provided in middle of the second pipe, wherein a droplet separator for separating a droplet from the compressed air is provided to the first pipe between the compressor and the air tank or to the second pipe between the air tank and the compressed air injection solenoid valve, and a first droplet discharging pipe extending from the droplet separator and a second droplet discharging pipe extending from a bottom portion of the air tank are allowed to join together, of which joined part is provided with one droplet discharging solenoid valve, wherein when the electrophotographic apparatus is operated at a non-printing mode, the droplet discharging solenoid valve is opened to discharge the droplet.

* * * * *